US005139471A

United States Patent [19]

Dornberger

[11] Patent Number: 5,139,471

[45] Date of Patent: Aug. 18, 1992

[54] MINI-GYM FOR EXERCISING THE LIMBS

[76] Inventor: Sharon A. Dornberger, P.O. Box 5191, Roseburg, Oreg. 97470

[21] Appl. No.: 637,664

[22] Filed: Feb. 12, 1991

[51] Int. Cl.[5] ..... A63F 7/06

[52] U.S. Cl. ..... 482/79; 273/58 C; 273/118 R; 128/25 R; 472/94; 482/148

[58] Field of Search ..... 272/65, 93, 1 R, 96; 273/108, 410, 411, 127 C, 58 C, 184 B, 118 R; 128/25 R

[56] References Cited

U.S. PATENT DOCUMENTS

| | | | |
|---|---|---|---|
| 61,960 | 2/1867 | Spofford et al. | 273/410 X |
| 1,540,670 | 6/1925 | Vidmer | 273/410 X |
| 1,935,174 | 11/1933 | Bisaillon et al. | 273/410 |
| 1,977,739 | 10/1934 | Sandstrom | 273/118 R |
| 2,991,083 | 7/1961 | Hartung | 273/127 C |
| 3,002,756 | 10/1961 | Bakalyar | 273/118 R |
| 4,083,561 | 4/1978 | Daffer, Jr. | 273/411 X |
| 4,286,786 | 9/1981 | Papadopoulos | 273/411 X |
| 4,323,250 | 4/1982 | Lansberry | 273/411 X |
| 4,478,420 | 10/1984 | Sowards | 272/65 X |
| 4,699,386 | 10/1987 | Carzino | 273/411 X |
| 4,703,931 | 11/1987 | Steen | 273/410 X |
| 4,934,699 | 6/1990 | Kaminkow et al. | 273/127 C X |

FOREIGN PATENT DOCUMENTS

| | | | |
|---|---|---|---|
| 0364182 | 4/1990 | European Pat. Off. | 273/410 |
| 2438051 | 2/1975 | Fed. Rep. of Germany | 273/118 R |

*Primary Examiner*—Gene Mancene
*Assistant Examiner*—L. Thomas

[57] ABSTRACT

A miniature courtyard apparatus provides a slanted lane for rolling a ball. A generally planar plate forms the floor. Legs are mounted to the lower surface of the plate adjacent to the rear edge for elevating the rear edge of the plate at a slope of about ten percent. The wall is fixedly attached to the plate to extend upwardly from the rear edge and a portion of the left and the right edges for preventing a ball rolled on the plate from travelling beyond the associated edges. The plate extends beyond the wall adjacent to the front edge. A bridge or cover is mounted on the wall to extend over the rear edge of the plate between the left and right edges. A bell is suspended from the cover generally centrally between the left and right edges in a position to be contacted by the ball when rolled along the plate upper surface. A resilient fabric covers the front edge of the plate. Canes may be mounted to the sides of the front to provide support to a user. The ball may be tethered to the ramp. A lane may be defined along the ramp to indicate relative positions between the front and rear edges.

14 Claims, 1 Drawing Sheet

MINI-GYM FOR EXERCISING THE LIMBS

BACKGROUND OF THE INVENTION

1. Field of the Invention

This invention relates to a self-contained, miniature courtyard apparatus, and more particularly, to such an apparatus providing limited repetitive activity during use.

2. Description of the Prior Art

General strength, stamina and stability are reduced during prolonged physical inactivity. Further, certain diseases, such as arthritis, builds up and the bones tend to become brittle. This development is more pronounced in those who are restricted to beds, wheelchairs, support appliances, or are otherwise restricted in their movement or travel.

Such effects can be delayed and even reversed with proper and safe physical activity. With those who are severely handicapped, even a small amount of movement can be a significant strain and discomfort. Thus, what is needed is an activity that will allow such a restricted person the opportunity to get limited exercise, while allowing more mobile individuals the opportunity to have increased exercise. Such an activity would then provide a wide range of use as a person increases his or her capabilities.

The present invention contemplates an apparatus having a low-angle ramp that allows a ball to be rolled up it and returned to a lower edge for return up the ramp when propelled by a person at the lower edge. Various devices have been produced that provide a structure that accommodates travel of a missile, typically a ball, into it.

For instance, U.S. Pat. Nos. 1,540,670; 4,083,561; 4,286,786; 4,478,420; and 4,703,931; and European publication No. 364 182 A all show nets or cages of various designs which serve to function as a target as well as direct a ball back toward a person using them. Such devices are large and cumbersome, being hardly practical for use by a person of limited mobility. Further, floors slope at such a dramatic angle and are so wide that the truly handicapped would hardly find them usable. Most of them are intended for use outdoors for practicing the sports of golf, soccer and tennis. These devises are inappropriate for a person restricted to the indoors or who has difficulty travelling on uneven ground. The '420 patent requires attachment on the edge of a trampoline. This configuration is not practical for a person restricted to a wheel chair or walker.

A novel device is described in U.S. Pat. No. 4,699,386. A machine feeds soccer balls to a practicing player for kicking toward a goal. The apparatus includes a sloped floor to return the balls to the machine, rather than to the player. Further, it is so large, it requires its own dedicated room.

Other devices, such as are shown in U.S. Pat. Nos. 61,960 and 1,935,174, provide a ramp, but also include means for capturing or retaining the projected object. They are also intended for use where the ball or missile is projected through the air, rather than along the surface of the ramp. The device disclosed in U.S. Pat. No. 2,991,083 is similar in providing a simulated golf putting green. However, the golf ball is captured by the device and mechanically propelled back toward the user. Such a device also requires extreme accuracy.

Another complex, but exercise-defeating device is a gate ramp for a pinball machine disclosed in U.S. Pat. No. 4,934,699. Rather than return a ball that is rolled up the ramp, the ramp flips down to capture the ball and open up an opening under the ramp for other balls to go into. Again, such a device is not useful for continuous exercising.

Another device unsuitable for continuous exercise is that disclosed in U.S. Pat. No. 4,323,250. This device is a target having a floor, sides, back, and top web, all of which have holes in them allowing a ball to pass through. The floor is horizontal, specifically for the purpose of not allowing a ball to roll off of it.

There thus remains a need for a simple, portable exercise device that allows people with limited movement to have continuous, though limited exercise.

SUMMARY OF THE INVENTION

These features are provided in the present invention by an apparatus constructed to allow one or more balls to return to the player no matter how lightly kicked they are.

Generally, the present invention provides a self-contained courtyard apparatus usable on a floor or other generally horizontal surface. It includes a missile, which typically is a ball. A ramp has a continuous, smooth upper surface, rear, front and side edges. The upper surface is inclined from the front edge toward the rear edge at a gradual slope sufficient for the ball to roll slowly toward the front edge from any location on the upper surface under the force of gravity.

A wall is fixedly attached to the ramp to extend upwardly from the rear edge and from at least a portion of the side edges for preventing a ball rolled onto the ramp from travelling beyond the associated edges of the ramp. A target is positioned generally centrally adjacent to the rear edge in a position to be contacted by the ball when rolled up the ramp from the front edge toward the rear edge.

In the preferred embodiment of the invention, six main parts are used. A generally planar plate forms the floor. Legs are mounted to the lower surface of the plate adjacent to only the rear edge for elevating the rear edge of the plate at a slope of about ten percent. The wall is fixedly attached to the plate to extend upwardly from the rear edge and a portion of the left and right edges. A bridge or cover is mounted on the wall to extend over the rear edge of the plate between the left and right edges. The target is a bell suspended from the cover generally centrally between the left and right edges in a position to be contacted by the ball when rolled along the plate upper surface. A resilient fabric covers the open front edge of the plate.

Such an apparatus returns the ball at a slow rate, making tracking and contacting the ball with a hand or foot possible for people who move and react slowly. This apparatus is also of particular therapeutic value in that it tends to engage the muscles involved in the activity in a varied and generally continuous way. The preferred apparatus can be used while the exerciser is in a sitting position or while standing. The ball(s) can be kicked with the feet or hit with the hands. This enables different forms of vital activity even from a wheelchair. It affords pleasurable exercise and activity for young children, as well as the elderly.

These and other features and advantages of the present invention will be apparent from the following detailed description of the preferred embodiment of the invention, described for purposes of illustration but not limitation, and as illustrated in the accompanying drawings.

DETAILED DESCRIPTION OF THE PREFERRED EMBODIMENTS

Figure 1:
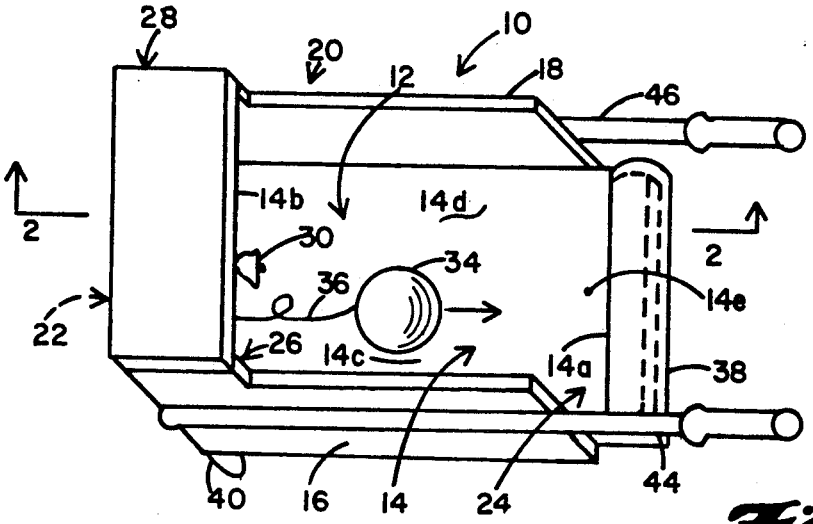
FIG. 1 is a perspective view of a first preferred embodiment made according to the invention.
Figure 2:
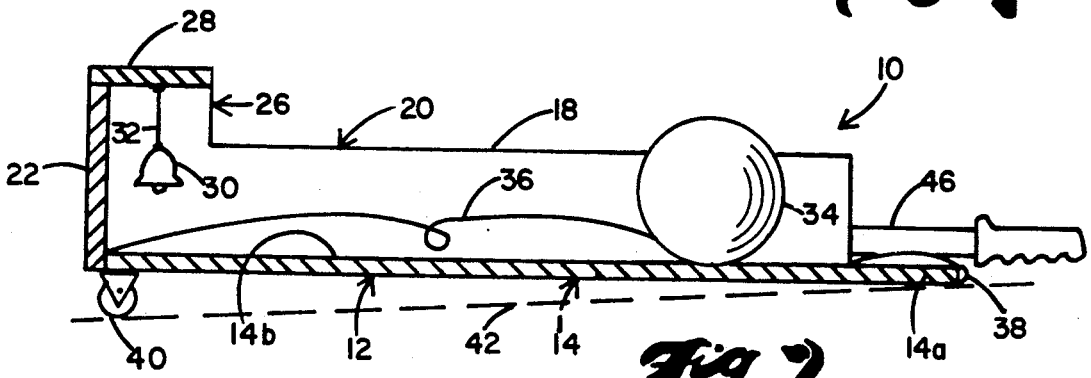
FIG. 2 is a cross-section taken along line 2—2 in FIG. 1.

Referring initially to FIGS. 1 and 2, an exercise apparatus, shown generally at 10, is made according to the invention. Apparatus 10 includes a ramp 12 having a floor 14 with a rectangular shape. The floor, the upper surface of a plate, has a lower or front edge 14*a* addressed by a person using apparatus 10, a rear or upper edge 14*b* opposite the front edge, opposing side edges 14*c* and 14*d*, and respective upper and lower surfaces 14*e* and 14*f*. The upper surface is relatively smooth and continuous.

The width of the floor along the front and rear edges can be of a size suitable for the people using it. This is preferable in the range of 16 to 30 inches, and is typically about 16 inches. The length along the side edges is preferably limited to the range of 18 to 24 inches, with 24 inches being typical. The floor may be made of plywood or solid wood with a thicknesses in the range of ¼ to ⅝ inches, preferably so that the front edge does not stick up too high above a surface on which it is placed. Besides plywood, it may be made of any reasonably rigid material, such as masonite, medite or plastic. The surface may also be covered as desired with paint, varnish, cloth or decorated paper under clear vinyl.

Fixed to the sides 14*c* and 14*d* of the floor are upstanding arms 16 and 18, respectively, of a wall shown generally at 20. These arms are preferably made of wood, approximately 3 inches less in length than the length of the sides of floor 14. They are preferably ¾ inch thick and 2 to 3½ inches high. Both arms extend from the rear floor edge to within about three inches of the front edge, leaving a front or "porch" section 24 of the floor without sides. The arms are attached to the floor by screws (and glue) from the bottom side of the floor, and may be covered with upholstery, vinyl, or any other decorative material desired.

The rear tops of the arms at 26 are preferably slightly higher than the rest of the arm for reasons which will become apparent.

A back or cross-piece 22 fits between the "arms" completing the three sides of the wall. The length of the cross piece is determined by the space created by the placement of the arms anchored to the floor. It is necessarily the same height (and usually the width) as the arms it connects. It is mounted flush to the back of the floor. This back piece may have the same decor as the court floor with a different covering on the outside back to allow it to look the same as the outside arm covering (the same being true of the inside arm decor).

A bridge (overhang) 28 is mounted at the rear of the apparatus 10 on top of the rear margins of arms 16 and 18 and cross piece 22 so that it is spaced above floor 14. Located at the center of this bridge may be attached a target, such as a small bell 30. Bell 30 is suspended, such as by a chain 32 so that it is at an elevation to be contacted by a projected missile, such as a ball 34. A plurality of balls may be used. When contacted, the target thus produces a sensory signal, in this case, a ring. This acts as an incentive to the player to produce the sound, encouraging use of the apparatus. For the more physically impaired the ball is preferably tethered to the apparatus, such as by a string 36, as shown, to avoid a runaway ball. The attachment for the tether is preferably seated into the floor (far-back center) before the bridge is attached to the arms and cross piece. It can, however, be tethered anywhere that provides the necessary freedom of movement of the ball, while limiting its travel much beyond the front edge of the apparatus floor.

A scuff protector or toe ramp 38, preferably formed as a double strip of vinyl, is attached to the front edge of the floor. It is thus directly in front of a user addressing the ball(s). It is placed over the edge of the front of the floor plate and rolled over to cover the bottom of the court floor as well. It may be two inches, top and bottom, on the child's model to two and a half to three inches on the other models. The toe ramp protects a user's feet from excessive jarring, or stubbing and also allows the player to toe-guide a loose ball easily onto the ball floor.

The user's feet need not touch the floor to engage the ball. The upper surface of the floor is for the ball(s) passage. The toe-ramp fits across entire front opening between the arm ends.

Feet (or lifts), such as roller or caster 40, shown in FIGS. 1 and 2, may be of varying kinds. They are used to elevate the rear of the floor, while the front of the floor rests directly on a support surface 42, as shown. The "lifts" should be at least 2 inches high, and placed to the far right and left or across the entire width of the rear edge of the floor on the lower surface.

This is important in construction to prevent accidental tipping of the apparatus to the side. Also, the height of the "lifts" is important to the return of the ball. If placed too high, it will prevent light kicks from moving the ball very far up the ramp, and it will return to the kicker very quickly. This makes it difficult for small children and the physically impaired from being able to continue to hit returning balls.

The "feet" or "lifts" may be fixed wooden or plastic legs, as well as the roller casters shown. The casters allow the apparatus to be readily moved, thereby facilitating its storage or creating added activity for youngsters. A strap may be attached to either side of the floor plate at the front also delighting a youngster with his or her very own "rickshaw", when provided along with the roller casters. Alternatively, special handles, such as handles 44 and 46 may be attached to the arms, make moving the apparatus easier, like a wheel barrow.

Figure 3:
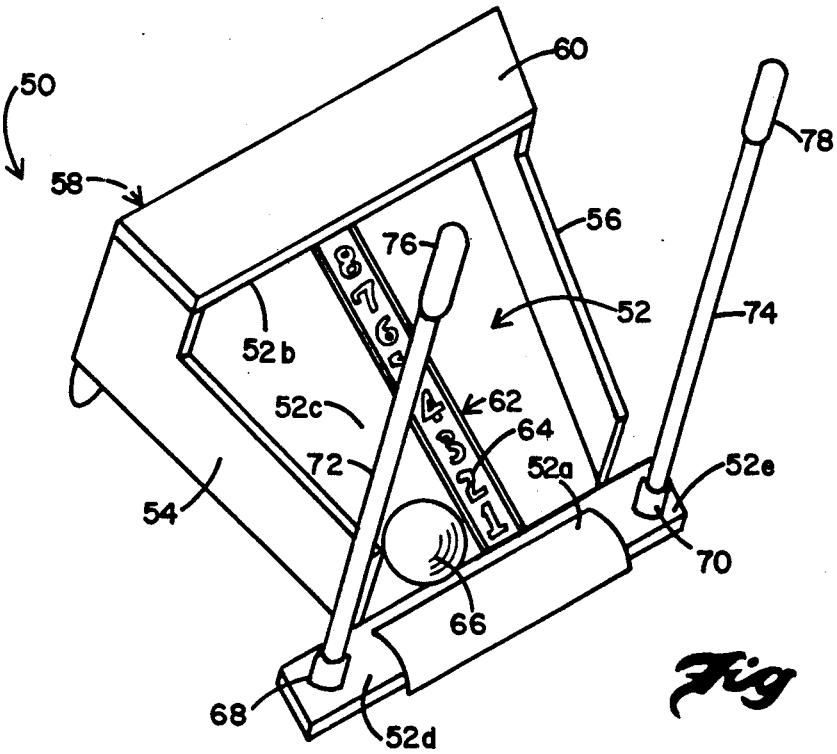
FIG. 3 is a perspective view of an alternative preferred embodiment of the invention.

Referring now to FIG. 3, an alternative embodiment of the invention is illustrated. The exercise apparatus 50 shown in this figure is generally constructed similarly to apparatus 10 described above. This apparatus, however, is generally wedge-shaped, having a floor 52 with a front edge 52*a* that is substantially shorter than the rear edge 52*b*, The sides 54 and 56, cross-piece 58 in back (not shown), and bridge 60 are constructed to conform to this shape. This shape tends to return the ball toward the center region of the front edge, permitting easier play for the less physically mobile users.

The upper surface 52*c* of the floor also is preferably painted or otherwise marked with a target ball lane 62. This lane is also marked with indexes identifying relative positions along the lane from the front to the back, such as by numerals 64, shown. Other forms of indexing may also be used. This is particularly beneficial for those who are able to propel the ball 66 only partially up lane 62.

As an additional feature of the invention, apparatus 50 includes projections or wings 52*d* and 52*e* extending sideways out from the sides of the front edge 52*a* of the floor, as shown. These wings thus rest on the support surface on which apparatus 50 is placed. Respective threaded cups 68 and 70, such as provided by a pipe flange having pipe threads, are mounted facing upwardly on the wings.

Into the cups are threaded pipe sections or canes 72 and 74 reaching to about waist high on expected users. On the upper cane ends are mounted hand grips 76 and 78 for holding and support by users who are unstable on their feet. By getting them to stand when using the apparatus, they receive increased exercise from use of the apparatus. Further, by making the canes so they screw onto the cups, they can readily be removed for use by those who do not require them, or for storage of the apparatus. The canes may be made of any suitable material, but plastic piping commonly known as PVC is particularly adaptable and inexpensive.

It will be apparent to one skilled in the art that variations in form and detail may be made in the preferred embodiment without varying from the spirit and scope of the invention as defined in the claims. The preferred embodiment is thus provided for purposes of explanation and illustration, but not limitation.

I claim:

1. A self-contained courtyard apparatus for use on a floor or other generally horizontal surface, comprising:

a ball;

a ramp having a constant slope and continuous, unobstructed, smooth upper surface, a rear edge, a front edge and side edges, the upper surface being inclined from the front edge toward the rear edge at a slope sufficient for the ball to roll toward the front edge from any location on the upper surface under the force of gravity;

a wall fixedly attached to the ramp to extend upwardly from the rear edge and at least a portion of the side edges for preventing a ball rolled on the ramp from travelling beyond the associated edges of the ramp; and a target positioned generally centrally adjacent to the rear edge in a position to be contacted by the ball when rolled up the ramp from the front edge toward the rear edge.

2. An apparatus according to claim 1 wherein the ramp includes a generally planar plate having the upper surface, and supports positioned along the rear edge for elevating the plate.

3. An apparatus according to claim 2 wherein the supports are wheels rotatably mounted to the plate, the apparatus further comprising means defining at least one handle positioned adjacent to the front edge of the plate.

4. An apparatus according to claim 1 wherein the target includes means for producing a sensory signal when contacted by the ball.

5. An apparatus according to claim 4 wherein the target is a bell.

6. An apparatus according to claim 1 further comprising a ceiling portion extending a sufficient distance over the rear edge of the upper surface to allow the ball to contact the wall along the rear edge when travelling along the upper surface.

7. An apparatus according to claim 6 wherein the target is suspended from the ceiling portion.

8. An apparatus according to claim 6 wherein the wall along the rear edge has a height greater than the diameter of the ball, and the ceiling portion extends toward the front edge a distance not greater than the height of the wall along the rear edge.

9. An apparatus according to claim 1 wherein the upper surface includes indexing means extending from adjacent to the front edge towards the rear edge for indicating respective relative positions along the upper surface between the front edge and the rear edge.

10. An apparatus according to claim 1 further comprising means for tethering the ball relative to the ramp in a manner allowing movement of the ball between the front edge and the rear edge.

11. An apparatus according to claim 1 further comprising resilient means covering the front edge of the ramp.

12. An apparatus according to claim 1 further comprising support means mounted adjacent to the front edge of the ramp for supporting at least partially a person standing adjacent to the front edge.

13. An apparatus according to claim 1 wherein the wall along the opposing side edges are spaced further apart adjacent to the rear edge than the opposing side edges are spaced apart adjacent to the front edge.

14. A self-contained courtyard apparatus for use on a floor or other generally horizontal surface, comprising:

a ball;

a generally planar plate having a continuous, smooth upper surface, lower surface, a rear edge, a front edge, a left edge and a right edge;

legs mounted to the lower surface of the plate adjacent only to the rear edge for elevating the rear edge of the plate at a slope of about ten percent;

a wall fixedly attached to the plate to extend upwardly from the rear edge and a portion of the left and right edges for preventing a ball rolled on the from travelling beyond the associated edges of the plate, the plate extending beyond the wall adjacent to the front edge;

a cover extending over the rear edge of the plate between the left and right edges;

a target suspended from the cover generally centrally between the left and right edges in a position to be contacted by the ball when rolled along the plate upper surface; and a resilient fabric covering the front edge of the plate.

* * * * *